US007241975B2

(12) United States Patent
Hamel et al.

(10) Patent No.: US 7,241,975 B2
(45) Date of Patent: Jul. 10, 2007

(54) IGNITER SYSTEMS WITH ASSOCIATED LEAD FRAME

(75) Inventors: Scott M. Hamel, Wilton, NH (US); Taehwan Yu, Sudbury, MA (US); Louis Castriotta, III, Keene, NH (US); Jack F. Eckalbar, Jr., Nashua, NH (US)

(73) Assignee: Saint-Gobain Ceramics and Plastics, Inc., Worcester, MA (US)

( * ) Notice: Subject to any disclaimer, the term of this patent is extended or adjusted under 35 U.S.C. 154(b) by 0 days.

(21) Appl. No.: 11/138,635

(22) Filed: May 25, 2005

(65) Prior Publication Data

US 2006/0011601 A1 Jan. 19, 2006

Related U.S. Application Data

(60) Provisional application No. 60/575,666, filed on May 28, 2004.

(51) Int. Cl.
*F23Q 7/22* (2006.01)
*H05B 3/03* (2006.01)

(52) U.S. Cl. ..... 219/270; 219/541; 219/552; 338/329; 338/332; 228/115; 228/122.1; 29/611; 29/621

(58) Field of Classification Search ..... 219/270, 219/267, 260, 541; 338/329; 228/115, 122.1
See application file for complete search history.

(56) References Cited

U.S. PATENT DOCUMENTS 4,058,789 A * 11/1977 Bavisotto et al. ..... 338/322
4,458,413 A * 7/1984 Tatum et al. ..... 29/827
5,055,361 A 10/1991 Dunn et al.
5,108,025 A 4/1992 Kang et al.
5,471,032 A * 11/1995 Spellman et al. ..... 219/270
5,564,618 A * 10/1996 Axelson ..... 228/124.1
5,750,958 A 5/1998 Okuda et al.
5,804,092 A * 9/1998 Axelson et al. ..... 219/270
6,078,028 A 6/2000 Cooper et al.
6,268,069 B1 * 7/2001 Ohashi et al. ..... 428/621
6,291,804 B1 * 9/2001 Fujii ..... 219/541
6,352,196 B1 3/2002 Lorenz
6,794,614 B2 * 9/2004 Taniguchi et al. ..... 219/270
6,845,217 B2 * 1/2005 Konishi ..... 392/407
6,933,471 B2 * 8/2005 Hamel et al. ..... 219/270
2003/0024969 A1 2/2003 Harris (Continued)

FOREIGN PATENT DOCUMENTS

EP 0 486 009 A1 5/1992

(Continued)

*Primary Examiner*—Philip H. Leung
*Assistant Examiner*—Stephen J. Ralis
(74) *Attorney, Agent, or Firm*—Peter F. Corless; Edwards Angell Palmer & Dodge LLP

(57) ABSTRACT

Resistive igniter systems are provided that comprise a metal substrate with an associated resistive igniter element in electrical connection through braze applied to the metal substrate. Igniter systems of the invention can enable significantly simplified manufacturing as well as notably higher yield production of more robust igniters. In preferred systems, the braze material is applied to the metal substrate prior to adjoining the igniter and metal substrate, which can enable application of a relatively precise amount of braze in a defined area of the metal substrate.

14 Claims, 3 Drawing Sheets

U.S. PATENT DOCUMENTS

2003/0132270 A1* 7/2003 Weil et al. ..... 228/122.1
2003/0146206 A1 8/2003 Tanaka et al.

FOREIGN PATENT DOCUMENTS

EP 0 930 282 A1 7/1999
EP 1 239 701 A2 9/2002
JP 01263420 A * 10/1989
JP 02075187 3/1990
JP 07263126 10/1995

* cited by examiner

IGNITER SYSTEMS WITH ASSOCIATED LEAD FRAME

The present application claims the benefit of U.S. provisional application No. 60/575,666, filed May 28, 2004, which is incorporated herein by reference.

FIELD OF THE INVENTION

The invention relates generally to resistive igniters and, more particularly, to resistive igniter systems that include a metal substrate such as a lead frame with a nested resistive igniter element in electrical connection through braze applied to the metal substrate. In preferred systems, braze material is applied to the metal substrate prior to adjoining a ceramic igniter and metal substrate, which can enable application of a relatively precise amount of braze in a defined area of the metal substrate.

BACKGROUND

Ceramic materials have enjoyed great success as igniters in gas-fired furnaces, stoves and clothes dryers. A ceramic igniter typically includes a ceramic hot surface element having a conductive end portion and a highly resistive portion. When the element ends are connected to electrified leads, the highly resistive portion (or "hot zone") rises in temperature. See, generally, U.S. Pat. Nos. 3,875,477, 3,928,910, 3,974,106, 4,260,872, 4,634,837, 4,804,823, 4,912,305, 5,085,237, 5,191,508, 5,233,166, 5,378,956, 5,405,237, 5,543,180, 5,785,911, 5,786,565, 5,801,361, 5,820,789, 5,892,201 and 6,028,292.

Since these igniters are resistively heated, each of its ends must be electrically connected to a conductive lead, typically a copper wire lead. However, problems are associated with connecting the ceramic hot surface element ends to leads. One issue has been bonding of the ceramic material and the lead wire do not bond well together. See EP 0486009, which uses a combination of braze and solder for affixing the ceramic and the lead wire. For a number of reasons, use of solder is less desirable, however, including a relatively laborious process as well as frequent damage of the ceramic igniter element by the high temperature (e.g. 1600–1800° C.) solder application.

Efforts have been made to manage problems caused by solder connections. For example, U.S. Pat. No. 5,564,618 to Axelson recognized that the CTE mismatch between the braze and the solder was causing breakage during the soldering step, and sought to minimize the braze by using a silk screening approach. U.S. Pat. No. 6,440,578 reports certain solder materials said to provide improve bonding properties. See also U.S. Pat. No. 6,635,358.

Other efforts have sought to eliminate solder from ceramic igniter termination systems, but these approaches have generally in either fragile or temporary systems. See, for instance, GB 2,059,959, which describes a redundancy of mechanical support for the hot surface element-electrical lead indicates that the reported solderless connection is relatively insecure. U.S. Pat. No. 5,804,092 reports a certain modular ceramic igniter system, in which the ceramic hot surface element is plugged into a socket having a conductive contact therein.

A highly useful ceramic igniter that does not employ solder for electrical connections is disclosed in U.S. Pat. No. 6,078,028 of Saint-Gobain Industrial Ceramics, Inc. Additional highly useful methods for producing ceramic igniters are disclosed in U.S. Pat. Nos. 5,564,618 and 5,705,261 and U.S. Published application 2003/0080103.

In addition to the difficulties to securely attach electrical connections to ceramic igniter elements, the affixation process can be laborious. See, for instance, U.S. Pat. Nos. 6,440,578 and 6,635,358.

It thus would be desirable to have new ceramic igniters that could provide enhanced performance properties. It would be particularly desirable to have new methods and systems that could provide a secure electrical connection to a ceramic igniter. It also would be particularly desirable to have new improved methods and systems for producing ceramic igniters.

SUMMARY OF THE INVENTION

We now provide new igniter systems that include a metal substrate with a resistive igniter element in electrical connection through braze applied to the metal substrate. We have found the igniter systems of the invention enable significantly simplified manufacturing as well as notably higher yield production of more robust igniters.

More particularly, in a preferred aspect, resistive igniter systems are provided that comprise a lead frame substrate, a resistive igniter and braze material. The braze material is applied to the lead frame substrate prior to adjoining the igniter and lead frame, which enables application of a relatively precise amount of braze in a defined area of the lead frame substrate. Preferred methods include application of a non-paste braze particularly a braze foil or strip to a lead frame sheet followed by formation of individual lead frames such as by metal stamping or other process.

These methods and systems of the invention can provide significant advantages over prior approaches that have applied braze paste to an assembled lead frame/igniter device. Among other things, such braze paste application is labor intensive and can result in varying deposition among each device. The manual paste application with a glue-type gun or other dispensing device may vary with the amount, pressure, exact deposition site and angle, etc. Additionally, characteristics of a braze paste material can vary with environmental conditions such as temperature and humidity, resulting in further variability among manufactured assemblies.

Preferably, the formed lead frame or other metal substrate comprises a braze material in a defined lead frame area that mates with a conductive zone area of an igniter element nested within the lead frame. Thermal treatment provides braze reflow that bonds the lead frame and igniter through the braze.

Systems of the invention can enable deposition of a braze source that is consistent with respect to placement and mass, which can be important to fabrication of a robust lead frame/igniter system. Braze may be deposited in a defined area raised above a lead frame surface whereby the braze may only make contact with a center area of a mating igniter surface.

Such more precise mating of the braze source and center of igniter can reduce the likelihood of braze material extending to an igniter element edge, which can stress and weaken the subsequently formed braze/ceramic bond. Indeed, it has been found that preferred igniter systems of the invention can exhibit exceptionally robust lead frame/ceramic igniter joints. See, for instance, the comparative results of Example 3, which follows.

A variety of braze materials may be employed in systems of the invention including copper and silver based compositions. We have found that braze compositions that comprise a substantial portion of silver (e.g. >60 or 70 weight percent of total braze composition being silver) can provide a particularly robust bond between a ceramic igniter and metal substrate that is resistant to high temperatures.

Thus, in one aspect, igniter systems having high silver content braze compositions are provided, including igniter systems comprising a braze composition having a silver content in excess of 60 or 70 weight percent. Preferred systems include resistive igniter system that comprise a metal substrate, a resistive element, and braze material having a silver content of at least about 70, 80, 90 or 95 weight percent based on total weight of the braze material.

A wide variety of igniter elements may be employed in systems of the invention. Typical ceramic igniters useful for systems of the invention contain both hot and cold zone portions. The hot zone(s) are comprised of a sintered composition containing both a conductive material and an insulating material, as well as, optionally but typically, a semiconductor material. Conductive or cold zone portions of ceramic igniters of the present invention will contain a sintered composition of similar components as the hot zone(s) of the igniter, but with comparably higher concentrations of the conductive material.

Igniter systems of the invention will have significant utility in a large number of applications, including e.g. ignition for gas heating units for residential and commercial buildings, cooking devices such as a gas cooktop or oven burner, and other apparatus that require rapid ignition of gas and liquid fuels. Preferred igniter systems of the invention are highly stable to high temperature environments such as may involve prolonged exposures at greater than 650° C. Thus, preferred igniter systems of the invention will be useful to provide ignition in oven systems including self-cleaning ovens, fuel cells, and the like.

As indicated above, the invention is useful for adhering a wide variety of resistive igniter elements to metal substrates and is particularly useful for adhering ceramic igniters to lead frame substrates. As referred to herein, the term lead frame is inclusive of a large variety of packaging substrates and may include essentially any metal substrate or material that is adhered to such as through a braze composition or otherwise associated with an igniter element, including e.g. metal strips (e.g. linear or non-linear strips such as a U-shaped strip), metal tabs and the like.

Other aspects of the invention are disclosed infra.

DETAILED DESCRIPTION OF THE INVENTION

As discussed above, we now provide new resistive igniter systems that include a metal substrate with an igniter element nested or otherwise associated with and in electrical connection through braze applied to the lead frame. Igniter systems of the invention enable significantly simplified manufacturing as well as notably higher yield production of more robust igniters. Preferred metal substrates include lead frame substrates that will nest one or more igniter elements.

In preferred systems the braze material employed is suitably in a strip or tape-like or foil-like form and in any event is other than a paste form (braze pastes often have a clay-like consistency and are insufficiently firm to form a strip or foil material). Such preferred non-paste braze materials can be conveniently applied to an igniter system substrate (e.g. lead frame substrate) such as by compression bonding as discussed above that can provide robust igniter/metal substrate joints following braze reflow.

As indicated above, while the following discussion often refers to in particular a lead frame substrate, the discussion is equally applicable to use of metal substrate materials that may not be conventionally or consistently referred to as lead frames and include e.g. linear and non-linear metal strips.

Figure 1:
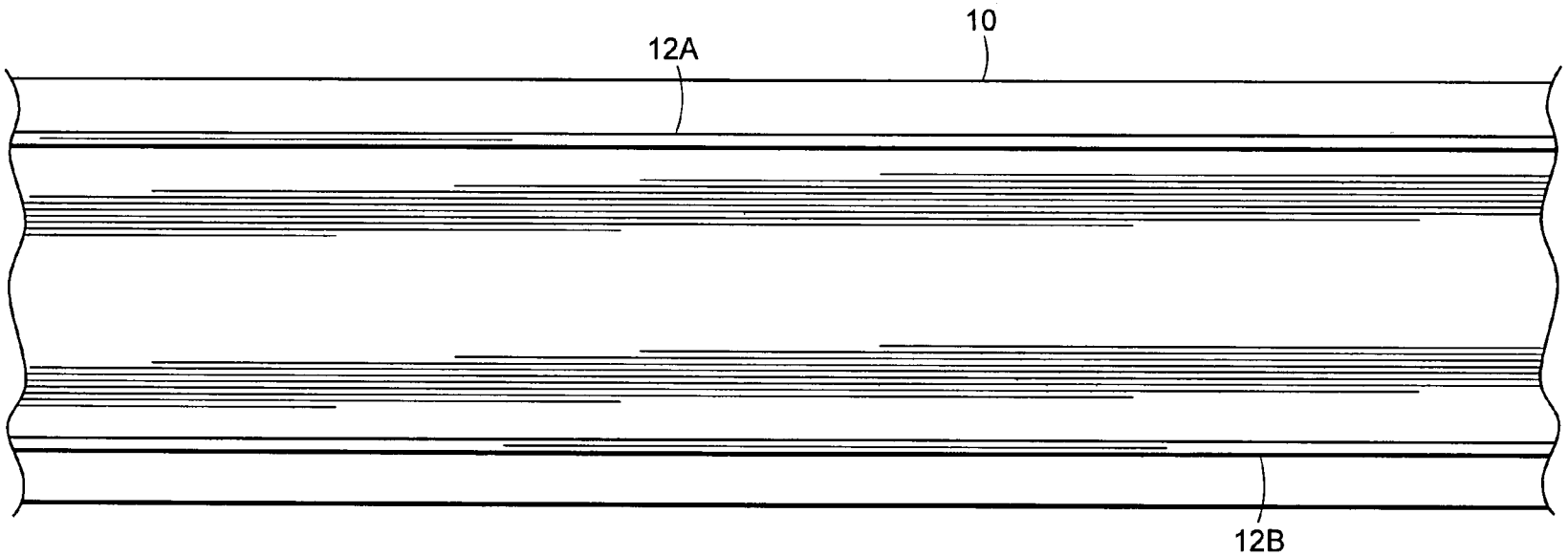
FIG. 1 depicts a partially processed lead frame substrate.

Referring now to the drawings, FIG. 1 depicts a sheet 10 useful to form lead frames or other metal substrates for igniter elements of the invention. Sheet 10 may be a variety of materials and is typically metal such as a stainless steel, aluminum, various alloys, and the like, with stainless steel being a preferred material. A particularly preferred metal substrate material is a 430 stainless steel sheet. In one preferred method, parallel channels 12A, 12B are formed along the length a metal lead frame substrate sheet, e.g. by a skiving procedure with an appropriate cutting tool to provide a channel configured to receive a braze composition. Suitable dimensions of channels 12A and 12B may vary widely. For at least certain systems, the maximum depth and width of the channels each may be from about 0.001 to 0.004 inches, more preferably from about 0.001 to 0.003 inches, with 0.002 inches being a particularly preferred depth and width. Preferably, the width of a channel will be less than the width of an igniter element (e.g. less than the width of an igniter cold zone leg) to avoid braze migration to igniter element edges during reflow. The shape of the channel bed also may suitably vary, e.g. with the particular skiving tool employed. A curved channel bed (i.e. U-shaped cross-sectional shape) may be preferred for many applications.

Braze materials may be applied to channels 12A and 12B by any of a variety of methods. For instance, in one application method, a tape or foil-like strip of braze is applied and press-fit into or compression bonded to the depressed surfaces of channels 12A and 12B. Braze foils are commercially available. Alternatively, a braze paste can be dispensed from a glue gun or other dispensing apparatus to at least substantially fill each of channels 12A and 12B with braze, although such manual paste application is considerably less preferred as discussed above.

Preferably, braze is applied in an amount sufficient to fill the channel (e.g., channels 12A and 12B shown in FIG. 1) and extend above the planar surface of sheet 10. By extending above the planar surface of substrate 10, the applied braze can make good mechanical contact with an igniter element. Braze application in accordance with the invention also can readily enable deposition of a quite thin braze layer, such as a braze layer have a thickness (height) of about 0.005 inches or less or even about 0.004 or about 0.003 inches or less or about 0.002 inches or less. Such thin braze layers can provide significant advantages including enhancing the integrity of the igniter/metal substrate bond. In particular, a lower braze volume or thickness will reduce stress resulting from the differences of coefficients of thermal expansion between the braze and ceramic igniter element. References herein to the thickness of a braze layer indicate the maximum vertical height of the braze layer, such as the distance from the bottom point of a channel 12A or 12B to the highest point of the layer (the highest point shown as 24*b* in FIG. 4).

A wide variety of braze materials may be employed. Suitable braze materials should be capable of forming an electrical connection with conductive portions of a ceramic igniter. Typically suitable brazes contain an active metal which can wet and react with the ceramic materials and so provide adherence by filler metals of the braze. Examples of specific active metals include titanium, zirconium, niobium, nickel, palladium and gold. In addition to one or more such active metals, the braze may contain one or more filler metals such as copper, silver, indium, tin, zinc, lead, cadmium and phosphorus. Preferred braze materials include copper/silver mixtures with active metals of titanium and/or nickel. A variety of suitable brazes are commercially available such as Cerametial and Lucanex available from Lucas-Milhaupt, Inc. in Cudahy, Wis., which contains titanium and fillers of silver and copper.

As discussed above, braze compositions that are predominately composed of silver are preferred for many applications and can provide notably robust bonds between a ceramic igniter and metal lead frame substrate. For such preferred high silver content braze compositions, preferably at least about 60 weight percent of the total braze composition is silver, more preferably at least about 70, 80, 90 or 95 weight percent of the total braze composition is silver, with the balance being materials such as copper and/or nickel and one or more active metals such as titanium. Particularly robust lead frame/ceramic igniter bonds have been provided with braze compositions having a silver content that is in excess of 90 or 95 weight percent, based on the total weight of the braze composition.

Figure 2:
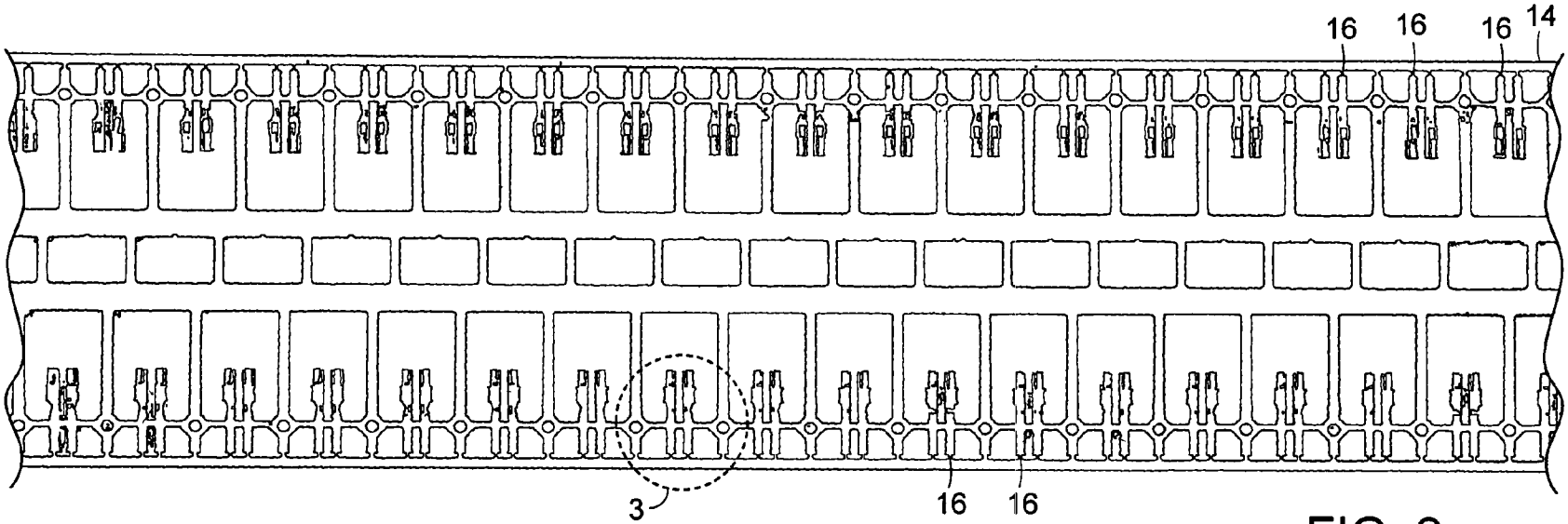
FIG. 2 depicts a processed lead frame substrate useful in the igniter systems of the invention.
Figure 3:
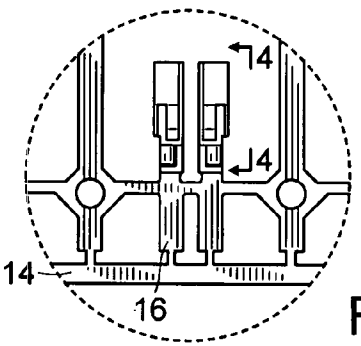
FIG. 3 shows an exploded view of two leads of the lead frame substrate of FIG. 2.

After braze has been applied to sheet 10, the sheet may be suitably machined such as through a metal stamping process to form a sheet 14 that contains a plurality of opposed, adjoined lead frame elements 16, as depicted in FIGS. 2 and 3.

Figure 7:
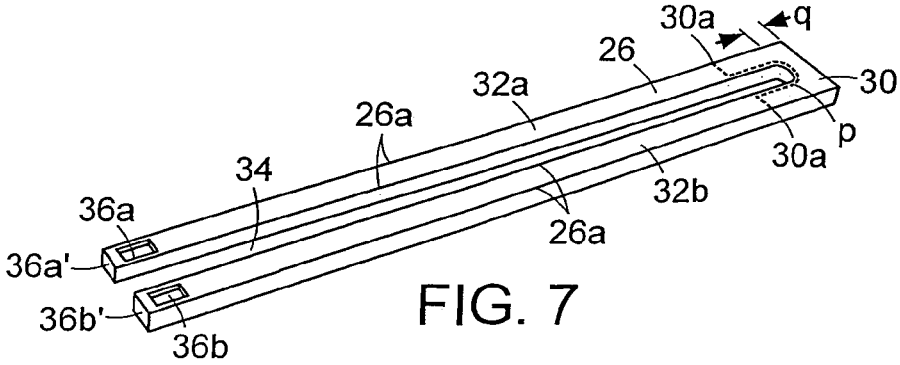
FIG. 7 shows an igniter element of the invention.

As discussed above, braze material may be deposited and the lead frame configured through a stamping process or other formation method to provide the braze source raised from the lead frame to mate with an igniter element conductive zone area but without contact to the igniter element edge (i.e. igniter edges 26*a* as depicted in FIG. 7, formed by the 90 degree angle between the igniter bottom surface (that mates with the applied braze) and the igniter sidewall). In a preferred system, prior to braze reflow, a raised braze deposit will not extend to within 0.05 microns of an edge of a mated igniter element.

While a variety of lead frame configurations may be formed in a sheet 10 and employed in accordance with the systems of the invention, preferred lead frames are adapted to reliably engage a ceramic igniter element.

Figure 4:
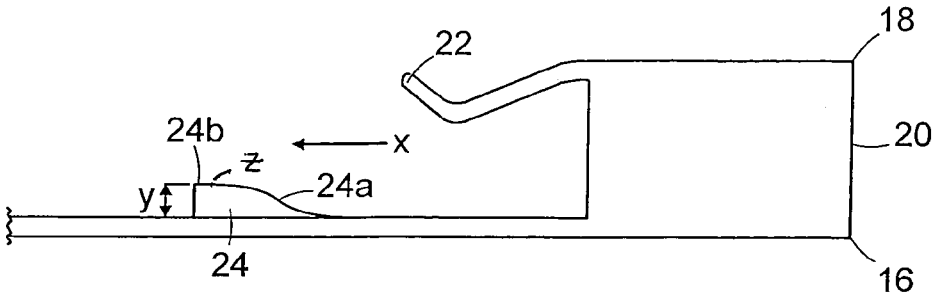
FIG. 4 shows a side view of an attachment element with braze.

Thus, as can be more particularly seen in FIG. 4, lead frame element 16 includes face 18 with aperture 20 through which a ceramic igniter (not shown in FIG. 4) is inserted in the depicted direction x. Though press-fit engagement, flange 22 can retain an inserted ceramic igniter within the lead frame 16.

As shown in FIG. 4, lead frame element 16 contains applied braze pad 24 which is preferably configured to facilitate nesting of a ceramic igniter element within the lead frame 16. Thus, as depicted in FIG. 4, braze pad proximate side 24*a* has an upward sloping side surface without sharp edges that could inhibit facile insertion of an igniter element into the lead frame. Suitable thicknesses of the braze pad (shown as "y" in FIG. 4) may vary and should be sufficient to provide a secure engagement of the igniter and lead frame element following thermal (reflow) treatment. As discussed above, application of a braze foil or tape material or other strip (non-paste) material can enable deposition of a thin braze layer which can enhance integrity of the metal/braze/ceramic joint. Generally suitable thicknesses y may be about 250 microns or less, more preferably about 150 microns or less, and an exposed top surface area (top surface "z" shown in FIG. 4) of less than about 4 square millimeters, more preferably less than about 3.6 or 3 square millimeters. As discussed above, references herein to the thickness of a braze layer (including value y) indicate the maximum vertical height of the braze layer, such as the distance from the bottom point of a channel 12A or 12B to the highest point of the layer shown as 26*b* in FIG. 4.

Figure 5:
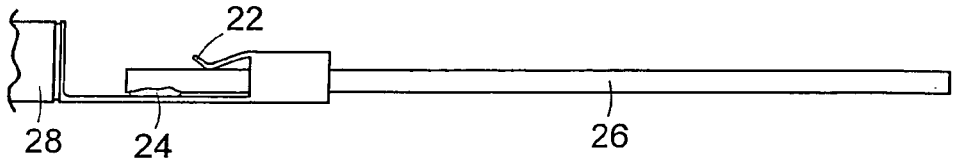
FIG. 5 shows a side view of an igniter system in accordance with the invention.
Figure 6:
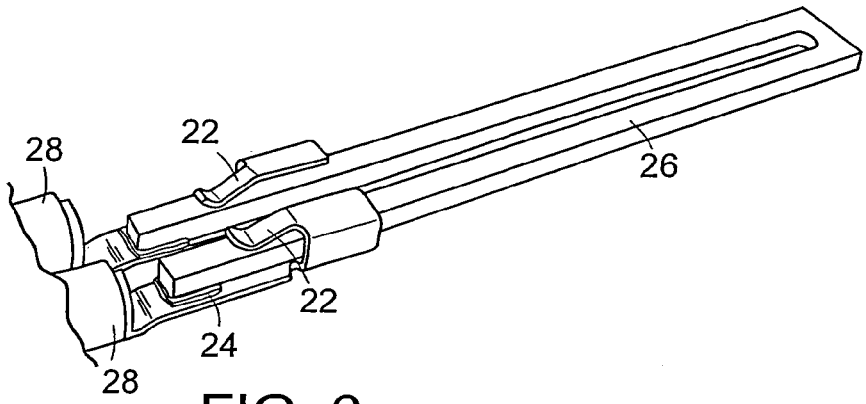
FIG. 6 shows an above view of an igniter system in accordance with the invention.

As generally depicted in FIGS. 5 and 6, the inserted ceramic igniter element 26 nests under flange 22 and above braze pad 24. Electrical connection to the lead frame/igniter system may be made by a lead wire extending to the assembly and braze though face 28. To fuse the braze to the ceramic igniter, the lead frame element with nested igniter is heated preferably under reduced pressures. For instance, for fusing of the braze, the igniter nested within the lead frame element may be heated at about 800° C. or greater for 5 to 10 minutes preferably under reduced pressures such as $10^{-3}$ torr or less.

FIG. 7 shows one preferred ceramic igniter 26 useful for systems of the invention that includes a hot zone portion 30 in contact with, and disposed between, cold zones 32*a* and 32*b*. Slotted area 34 is positioned beneath hot zone 30 and between cold zones 32*a* and 32*b*. Alternatively, rather than slotted area 34, the igniter may comprise a ceramic heat sink (not shown) interposed between the cold zones 32*a* and 32*b* and in contact with hot zone 30. Cold zone ends 36*a*' and 36*b*' are located distal from hot zone 30. As shown in FIG. 7, cold zone distal ends 36*a*' and 36*b*' may contain recesses 36*a* and 36*b* that mate with braze areas of a lead frame element.

As discussed above, a wide variety of igniters may be employed in systems of the invention. For instance, for many applications, substantially U-shaped igniters such as those depicted in FIGS. 6 and 7 will be suitable. Other igniter configurations such as elements that are linear without excised middle portion (i.e. slotless deign) as exemplified by the igniters disclosed in U.S. Pat. Nos. 6,002,107, 6,028,292 and 6,278,087 also will be suitable for many applications. Each such design has a highly conductive cold zone and more highly resistive hot zone, as discussed above. Suitable dimensions of hot and cold zones are disclosed in U.S. Pat. Nos. 5,191,508, 6,002,107, 6,028,292 and 6,278,087.

More particularly, the dimensions of the hot zone region may suitably vary. In the generally rectangular igniter design depicted in FIGS. 6 and 7, the hot zone path length (depicted as distance "p" in FIG. 7) should be sufficient to avoid electrical shorts or other defects. In one preferred system, that distance "p" is 0.5 cm.

The hot zone bridge height (depicted as distance "q" in FIG. 7) also should be of sufficient size to avoid igniter defects, including excessive localized heating, which can result in igniter degradation and failure.

The hot zone "legs" that extend down the length of the igniter will be limited to a size sufficient to maintain the overall hot zone electrical path length (p in FIG. 7) to within a preferred dimension, such as about 2.5 or 2 cm or less.

The composition of the hot zone 30, cold zones 32*a*, and 32*b* and heat sink (if employed) of a ceramic igniter of the present invention may suitably vary. Preferred compositions for those regions are disclosed in U.S. Pat. No. 6,582,629 to Lin et al., U.S. Pat. No. 5,786,565 to Willkens et al. and U.S. Pat. No. 5,191,508 to Axelson et al.

More particularly, the composition of the hot zone 30 should be such that the hot zone exhibits a high temperature (i.e. 1350° C.) resistivity of between about 0.01 ohm-cm and about 3.0 ohm-cm, and a room temperature resistivity of between about 0.01 ohm-cm and about 3 ohm-cm.

A preferred hot zone 30 contains a sintered composition of an electrically insulating material, a metallic conductor, and, in an optional yet preferred embodiment, a semiconductor material as well. As used herein, the term "electrically insulating material" or variations thereof refer to a material having a room temperature resistivity of at least about $10^{10}$ ohm-cm, while the terms "metallic conductor," "conductive material" and variations thereof signify a material that has a room temperature resistivity of less than about $10^{-2}$ ohm-cm, and the terms "semiconductive ceramic," "semiconductor material" or variations thereof denote a material having a room temperature resistivity of between about 10 and $10^8$ ohm-cm.

In general, an exemplary composition for a hot zone 30 includes (a) between about 50 and about 80 volume percent (vol % or v/o) of an electrically insulating material having a resistivity of at least about $10^{10}$ ohm-cm; (b) between about 5 and about 45 v/o of a semiconductive material having a resistivity of between about 10 and about $10^8$ ohm-cm; and (c) between about 5 and about 25 v/o of a metallic conductor having a resistivity of less than about $10^{-2}$ ohm-cm.

Preferably, the hot zone 30 comprises 50–70 v/o of the electrically insulating material, 10–45 v/o of the semiconductive ceramic, and 6–16 v/o of the conductive material.

Typically, the metallic conductor is selected from the group consisting of molybdenum disilicide, tungsten disilicide, and nitrides such as titanium nitride, and carbides such as titanium carbide, with molybdenum disilicide being a generally preferred metallic conductor. In certain preferred embodiments, the conductive material is $MoSi_2$, which is present in an amount of from about 9 to 15 vol % of the overall composition of the hot zone, more preferably from about 9 to 13 vol % of the overall composition of the hot zone.

Generally preferred semiconductor materials, when included as part of the overall composition of the hot 30 and cold zones 32*a*, 32*b* include, but are not limited to, carbides, particularly silicon carbide (doped and undoped), and boron carbide. Silicon carbide is a generally preferred semiconductor material.

Suitable electrically insulating material components of hot zone compositions include, but are not limited to, one or more metal oxides such as aluminum oxide, a nitride such as a aluminum nitride, silicon nitride or boron nitride; a rare earth oxide (e.g., yttria); or a rare earth oxynitride. Aluminum nitride (AlN) and aluminum oxide ($Al_2O_3$) are generally preferred.

Particularly preferred hot zone compositions of the invention contain aluminum oxide and/or aluminum nitride, molybdenum disilicide, and silicon carbide. In at least certain embodiments, the molybdenum disilicide is preferably present in an amount of from 9 to 12 vol %.

As discussed above, igniters of the invention typically also contain at least one or more low resistivity cold zone region 32*a*, 32*b* in electrical connection with the hot zone. Typically, a hot zone 30 is disposed between two cold zones 32*a*, 32*b*, which are generally comprised of, e.g., AlN and/or $Al_2O_3$ or other insulating material; SiC or other semiconductor material; and $MoSi_2$ or other conductive material.

Preferably, cold zone regions 32*a*, 32*b* will have a significantly higher percentage of the conductive and/or semiconductive materials (e.g., SiC and $MoSi_2$) than are present the hot zone. Accordingly, cold zone regions typically have only about ⅕ to 1/1000 of the resistivity of the hot-zone region, and do not rise in temperature to the levels of the hot zone. More preferred is where the cold zone(s) room temperature resistivity is from 5 to 20 percent of the room temperature resistivity of the hot zone.

A preferred cold zone composition for use in igniter of the invention comprises about 15 to 65 v/o of aluminum oxide, aluminum nitride or other insulator material, and about 20 to 70 V/O $MoSi_2$ and SiC or other conductive and semiconductive material in a volume ratio of from about 1:1 to about 1:3. More preferably, the cold zones comprise about 15 to 50 v/o of aluminum oxide and/or aluminum nitride, about 15 to 30 v/o SiC, and about 30 to 70 v/o $MoSi_2$. For ease of manufacture, the cold zone composition is preferably formed of the same materials as the hot zone composition, but with the relative amounts of semiconductive and conductive materials being greater in the cold zone(s) than the hot zone(s).

The electrically insulating heat sink if employed should be comprised of a composition that provides sufficient thermal mass to mitigate convective cooling of the hot zone. Additionally, when disposed as an insert between two conductive legs as described above (in place of slotted 34 shown in FIG. 7), the heat sink should provide mechanical support for the extended cold zone portions serve to make the igniter more rugged. Preferably, such an the electrically insulating heat sink has a room temperature resistivity of at least about $10^4$ ohm-cm and a strength of at least about 150 MPa. More preferably, the heat sink material has a thermal conductivity that is not so high as to heat the entire heat sink and transfer heat to the leads, and not so low as to negate its beneficial heat sink function.

Suitable ceramic compositions for a heat sink include compositions comprising at least about 90 vol % of at least one of aluminum nitride, boron nitride, silicon nitride, alumina and mixtures thereof. Where a hot zone composition of AlN—$MoSi_2$—SiC is employed, a heat sink material comprising at least 90 vol % aluminum nitride and up to 10 vol % alumina can be preferred for compatible thermal expansion and densification characteristics.

Ceramic igniters of the invention can be employed with a variety of voltages, including, but not limited to, nominal voltages of 6, 8, 12, 24, 120, 220, 230 or 240 volts.

The processing of the ceramic component (i.e., green body processing and sintering conditions) and the preparation of the igniter from the densified ceramic can be done by conventional methods. Typically, such methods are carried out in substantial accordance with U.S. Pat. No. 5,786,565 to Willkens et al.; U.S. Pat. No. 5,405,237 to Washburn; and U.S. Pat. No. 5,191,508 to Axelson et al., the disclosures of which are incorporated by reference herein. See also Example 1 which follows, for illustrative conditions.

For example, a formed billet of green body igniters can be subjected to a first warm press (e.g. less than 1500° C. such as 1300° C.), followed by a second high temperature sintering (e.g. 1800° C. or 1850° C.). The first warm sintering provides a densification of about 65 or 70% relative to theoretical density, and the second higher temperature sintering provides a final densification of greater than 99% relative to theoretical density.

In preferred igniter production methods a billet sheet is provided that comprises a plurality of affixed or physically attached "latent" igniter elements. The billet sheet has hot and cold zone compositions that are in a green state (not densified to greater than about 96% or 98% theoretical density), but preferably have been sintered to greater than about 40% or 50% theoretical density and suitably up to 90 ort 95% theoretical density, more preferably up to about 60 to 70% theoretical density. Such a partial densification is suitably achieved by a warm press treatment, e.g. less than 1500° C. such as 1300° C., for about 1 hour under pressure such as 3000 psi and under argon atmosphere.

It has been found that if the hot and cold zones compositions are densified at greater than 75 or 80 percent of theoretical density, the billet will be difficult to cut in subsequent processing steps. Additionally, if the hot and cold zones compositions are densified at less than about 50 percent, the compositions often degrade during subsequent processing. The hot zone portion extends across a portion of the thickness of the billet, with the balance being the cold zone.

The billet may be of a relatively wide variety of shapes and dimensions. Preferably, the billet is suitably substantially square, e.g. a 9 inch by 9 inch square, or other suitable dimensions or shapes such as rectangular, etc. The billet is then preferably cut into portions such as with a diamond cutting tool. Preferably those portions have substantially equal dimensions. For instance, with a 9 inch by 9 inch billet, preferably the billet is cut into thirds, where each of the resulting sections is 9 inches by 3 inches.

The billet is then further cut (suitably with a diamond cutting tool) to provide individual igniters. A first cut will be through the billet, to provide physical separation of one igniter element from an adjacent element. Alternating cuts will not be through the length of the billet material, to enable insertion of the insulating zone (heat sink) into each igniter. Each of the cuts (both through cuts and non-through cuts) may be spaced e.g. by about 0.2 inches.

After insertion of the heat sink zone, the igniters then can be further densified, preferably to greater than 99% of theoretical density. Such further sintering is preferably conducted at high temperatures, e.g. at or slightly above 1800° C./, under a hot isostatic press.

The several cuts made into the billet can be suitably accomplished in an automated process, where the billet is positioned and cut by a cutting tool by an automated system, e.g. under computer control.

The densified igniter element then can be mounted in a lead frame substrate as disclosed above and affixed thereto with braze. Electrical connections to the igniter can be provided by lead wires contacting the braze, as discussed above.

As indicated above, igniters of the invention may be used in many applications, including gas phase fuel ignition applications such as furnaces and cooking appliances, baseboard heaters, boilers, and stove tops.

Igniters of the invention also may be employed in other applications, including for use as a heating element in a variety of systems. More particularly, an igniter of the invention can be utilized as an infrared radiation source (i.e. the hot zone provides an infrared output) e.g. as a heating element such as in a furnace or as a glow plug, in a monitoring or detection device including spectrometer devices, and the like.

Additionally, as discussed above, preferred ceramic igniters of the invention will be useful at high temperature environments e.g. in excess of about 650° C., 700° C., 750° C. or 800° C. For instance, preferred igniter systems of the invention will be useful for ignition in self-cleaning ovens, fuel cells, and the like.

The following non-limiting examples are illustrative of the invention. All documents mentioned herein are incorporated herein by reference in their entirety.

EXAMPLE 1

Igniter Fabrication

Igniters used in systems of the invention may be prepared as follows. Hot zone and cold zone compositions are prepared as follows. The hot zone composition comprises 70.8 volume % (based on total hot zone composition) AlN, 20 volume % (based on total hot zone composition) SiC, and 9.2 volume % (based on total hot zone composition) $MoSi_2$. The cold zone composition comprises 20 volume % (based on total cold zone composition) AlN, 20 volume % (based on total cold zone composition) SiC, and 60 volume % (based on total cold zone composition) $MoSi_2$. The cold zone composition is loaded into a hot die press die and the hot zone composition loaded on top of the cold zone composition in the same die. The combination of compositions is densified together under heat and pressure to provide the igniter.

EXAMPLE 2

Igniter System Construction

An igniter system of the invention is prepared as follows. Parallel channels are skived in a 430 stainless steel sheet to provide configuration of dual channels as generally shown in FIG. 1. Silver braze foil is compression bonded along the dual channels and the sheet with braze is metal stamped to provide the sheet of plurality of attached lead frames as shown in FIG. 2. The braze foil has about 96 weight percent silver content, the balance being titanium and copper.

Hairpin sintered ceramic igniters configured as generally shown in FIGS. 5 and 6 (available from Saint-Gobain Corporation, Worcester, Mass.) are inserted into lead frame elements of the sheet and the elements separated for each igniter. The discrete igniters are then fused (braze reflow) by heating the nested igniters at about 800° C. for 10 minutes in a vacuum oven at about $1\times10^{-3}$ torr.

EXAMPLE 3

Braze Composition Evaluations

Bend tests were performed with ceramic igniter nested in lead frame elements with reflowed braze to evaluate different braze materials. Tested were generally identical ceramic igniter elements mounted in identical lead frames of the design described in Example 2 above but with differing braze materials. The nested igniters were fixed at one end and then bent downwards by a probe applied to the unattached igniter end.

The igniter element that had the high silver content (about 96 weight percent of total composition silver) inlaid braze exhibited the highest bend test results. CuSiN (less than 70 weight percent silver) inlaid braze showed the next best results and an improvement over the igniter/lead frame joint formed with a copper/silver braze paste (not inlaid foil). The failure mode for the igniter with the high silver content (96 weight percent) inlaid braze was break of the ceramic igniter element. The failure mode for the other two tested nested igniters was a ceramic pullout at the braze joint.

The invention has been described in detail with reference to particular embodiments thereof. However, it will be appreciated that those skilled in the art, upon consideration of this disclosure, may make modifications and improvements within the spirit and scope of the invention.

What is claimed is:

1. A method for producing a ceramic igniter system comprising:

(a) applying a braze material to a metal lead frame substrate, wherein the braze material is compression bonded to one or more channels of the lead frame substrate; and thereafter, (b) associating a resistive ceramic igniter element within file lead frame substrate, whereby the igniter element contacts the braze material.

2. The method of claim 1 wherein the lead frame substrate comprises one or more channels and the braze material occupies the one or more channels.

3. The method of claim 2 wherein the width of the one or more channels is less than the width of the ceramic igniter element.

4. The method of claim 1 wherein a non-paste braze material is applied to the lead frame substrate.

5. The method of claim 2 wherein a strip of braze materials is applied to one or more channels of the lead frame substrate.

6. The method of claim 5 wherein individual lead frames are formed by metal stamping.

7. The method of claim 1 wherein the braze material is applied to a lead frame sheet and thereafter individual lead frames are formed from the sheet with braze material thereon.

8. The method of claim 1 wherein the braze material is raised above the lead frame substrate to mate with the igniter.

9. The method of claim 1 wherein the braze material does not extend to an igniter edge.

10. The method of claim 1 wherein the igniter comprises a recessed area that mates with the braze material.

11. The method of claim 1 wherein the braze has a sloped vertical face prior to curing.

12. A method for producing a ceramic igniter system comprising:

(a) compression bonding a ship of non-paste braze material to a metal lead frame substrate comprising one or more channels and the braze material occupies the one or more channels; and thereafter, (b) associating a resistive ceramic igniter element within the lead frame substrate, whereby the igniter element contacts the braze material, the igniter element width being greater than the width of lead frame channel.

13. The method of claim 12 wherein the braze material is bonded to a lead frame sheet and thereafter individual lead frames are formed from the sheet with braze material thereon.

14. The method of claim 13 wherein individual lead frames are formed by metal stamping.

* * * * *